US005757396A

United States Patent [19]

Bruner

[11] Patent Number: 5,757,396

[45] Date of Patent: May 26, 1998

[54] INK JET PRINTHEAD HAVING AN ULTRASONIC MAINTENANCE SYSTEM INCORPORATED THEREIN AND AN ASSOCIATED METHOD OF MAINTAINING AN INK JET PRINTHEAD BY PURGING FOREIGN MATTER THEREFROM

[75] Inventor: Dan M. Bruner, Cypress, Tex.

[73] Assignee: Compaq Computer Corporation, Houston, Tex.

[21] Appl. No.: 269,446

[22] Filed: Jun. 30, 1994

[51] Int. Cl.[6] ..... B41J 2/165

[52] U.S. Cl. ..... 347/27; 347/12; 347/35; 347/68

[58] Field of Search ..... 347/27, 10, 11, 347/12, 13, 48, 30, 35, 68

[56] References Cited

U.S. PATENT DOCUMENTS

| | | | |
|---|---|---|---|
| 4,245,224 | 1/1981 | Isayama et al. | 347/35 X |
| 4,558,332 | 12/1985 | Takahashi | 347/14 |
| 4,563,688 | 1/1986 | Braun . | |
| 4,609,925 | 9/1986 | Nozu et al. | 347/27 |
| 4,668,965 | 5/1987 | Tanaka et al. | 347/26 |
| 4,800,403 | 1/1989 | Accattino et al. | 347/30 |
| 5,428,380 | 6/1995 | Ebisawa | 347/35 |
| 5,436,648 | 7/1995 | Stortz et al. | 347/10 |
| 5,438,350 | 8/1995 | Kerry | 347/12 |
| 5,461,403 | 10/1995 | Wallace et al. | 347/10 |
| 5,530,462 | 6/1996 | Takahashi et al. | 347/23 |

*Primary Examiner*—John E. Barlow, Jr.
*Attorney, Agent, or Firm*—Vinson & Elkins L.L.P.

[57] ABSTRACT

An ink jet printhead having an ultrasonic maintenance system incorporated therein and an associated method of maintaining an ink jet printhead by purging foreign matter therefrom. To forcibly eject foreign matter from an ink-carrying channel, the ink jet printhead is ultrasonically vibrated at a frequency of at least 20 kHz. Vibration may be initiated upon cessation of print operations or at selected time intervals for selected periods of time and may take place while the ink jet printhead is located within a print area portion of an associated ink jet printer where print operations are conducted or after the ink jet printhead is shuttled to a maintenance area. Foreign matter may also be ejected by applying a purging pulse to the ink-carrying channel. The purging pulse is generated by applying a voltage differential to a sidewall actuator laterally bounding the ink-carrying channel which is twice the magnitude of the voltage differential applied to eject a droplet of ink from the ink-carrying channel. The ink jet printhead may also be heated during the ultrasonic vibration thereof.

20 Claims, 3 Drawing Sheets

INK JET PRINTHEAD HAVING AN ULTRASONIC MAINTENANCE SYSTEM INCORPORATED THEREIN AND AN ASSOCIATED METHOD OF MAINTAINING AN INK JET PRINTHEAD BY PURGING FOREIGN MATTER THEREFROM

BACKGROUND OF THE INVENTION

1. Field of the Invention

The present invention generally relates to ink jet printhead apparatus and, more particularly, to an ink jet printhead having an ultrasonic maintenance system incorporated therewith for removing contaminating foreign matter therefrom.

2. Description of Related Art

Ink jet printing devices use the ejection of tiny droplets of ink to produce an image. The devices produce highly reproducible and controllable droplets of ink, such that an ejected droplet may be precisely directed to a location specified by digitally stored image data for deposition thereat. Most ink jet printing devices commercially available may be generally classified as either a "continuous jet" type ink jet printing device where droplets are continuously ejected from the printhead and either directed to or away from a substrate, for example, a sheet of paper, depending on the desired image to be produced or as a "drop-on-demand" type ink jet printing device where droplets are ejected from the printhead in response to a specific command related to the image to be produced and all such ejected droplets are directed to the substrate for deposition.

Many such ink jet printheads, particularly "high density" ink jet printheads characterized by an orifice size on the order of 50 to 100 microns, are susceptible to deteriorations in print quality due to the accumulation of foreign matter or agglomeration of ink that might clog the channels and/or orifices of the ink jet printhead, thereby preventing ink from being ejected from the ink jet printhead in an efficient and effective manner. Materials responsible for degrading operation of the ink jet printhead range from printhead and manufacturing debris to paper dust and dried ink.

In order to remove any such materials from the ink jet printhead, maintenance stations have been incorporated in many ink jet printers having a shuttle type ink jet printhead. Maintenance stations are typically located to one side of the printing area where droplets of ink are directed to selected locations on a substrate such a sheet of paper. At selected times, the ink jet printhead is shuttled to the maintenance station where foreign matter is removed from the printhead. For a typical ink jet printer, the printhead is shuttled to the maintenance station during power-up, remains at the maintenance during rest periods when the printer is not in use, and will periodically visit the maintenance station during printing. For example, an ink jet printhead may visit the maintenance station after every ten lines of printing.

The sophistication and complexity of the cleaning process performed at maintenance stations varies dramatically between ink jet printers. For example, some maintenance stations are equipped with a rubber, squeegee-like system which wipes foreign matter from the orifices of the ink jet printhead each time the printhead visits the maintenance station. Typically, these systems wipe the printhead at power-up, after every about ten lines of printing and whenever the printer is at rest. While both relatively simple and inexpensive, such systems are only able to remove a limited amount of foreign matter from an ink jet printhead. Accordingly, most maintenance stations also include one or more other cleaning devices.

It has long been appreciated that foreign material which has accumulated at the inlet of the orifice of an ink jet printhead may be removed by the forced ejection of ink or another liquid, for example, a solvent. The most basic of the cleaning devices which apply this concept include a blotter located at the maintenance station. When the ink jet printhead enters the maintenance station and aligns itself with the blotter, the ink jet printhead will initiate the ejection of a droplet or droplets of ink from its channels. By creating a flow of ink, the cleaning system hopes to draw foreign matter out of its channels and orifices. The ejected droplets of ink, as well as any foreign matter carried thereby, strike and are retained by the blotter.

Other cleaning systems are more complicated. One such system uses a piston/plunger type arrangement to draw foreign matter from the channels and orifices of the ink jet printhead. In such systems, the plunger engages the orifices of the printhead. The piston then creates vacuum pressure to draw ink from the channels of the ink jet printhead. Again, the flow of ink is intended to draw foreign matter from the channels and orifices of the printhead. The removed ink is then drained into a used ink reservoir, in alternate configurations thereof, may be located at the ink supply or at another location within the printer.

Another cleaning system includes a gasket type device which sealingly engages the front end of the ink jet printhead. Once sealed, the ink jet printhead fires into the gasket, thereby causing an ink flow intended to draw accumulated foreign matter out of the channels and orifices of the ink jet printhead. The ejected ink is then drained into a used ink reservoir which, as before, may be located at the ink supply or at another location within the printer. Another cleaning device which includes a gasket type device further includes a reservoir of a solvent material at the maintenance station. After engaging the front end of the ink jet printhead, a selected quantity of solvent is forcibly injected into the ink jet printhead to wash away or dissolve foreign matter. The solvent is then purged from the ink jet printhead, for example, by firing the channels. The ejected solvent is then stored at a used solvent reservoir.

Numerous shortcomings are inherent in all of the aforementioned systems. If the cleaning system incorporates a blotter or other ink or solvent drainage and reservoir system within the printer, the printer will require periodic maintenance to replace the blotter and/or remove collected ink or solvent. On the other hand, cleaning systems which include devices which physically engage the ink jet printhead and/or collect ink or solvent ejected by the ink jet printhead will necessarily include complicated mechanical and/or plumbing systems which add to both the manufacturing and maintenance cost for the printhead. Systems that inject solvents into the printhead are only suitable for use in large, well ventilated areas that will prevent the accumulation of harmful fumes. Furthermore, a printer which includes any type of maintenance station as part of its cleaning system will consume up to one-eighth of its entire space for the maintenance station. Finally, as the maintenance station must be as wide as the ink jet printhead itself, maintenance stations are generally viewed as unsuitable for use in combination with the page wide ink jet printheads presently being developed.

It can be readily seen from the foregoing that it would be desirable to provide a self-maintaining ink jet printhead, suitable for use with or without a maintenance station, capable of removing contaminating foreign matter therefrom without the need for complicated and expensive maintenance systems which require periodic attention by the operator. It is, therefore, an object of the present invention to provide such an improved ink jet printhead.

SUMMARY OF THE INVENTION

In a first embodiment, the present invention is of a method of purging foreign matter from selected ink-carrying channels of a shuttle-type ink jet printhead. When an ink-carrying channel is selected for purging, the ink jet printhead ceases all printing operations and shuttles from a print area where printing operations are conducted to a maintenance area. A pressure pulse is then applied to the selected ink-carrying channel to purge foreign matter therefrom. The printhead then returns to the print area where printing operations are resumed. In one aspect thereof, the printhead includes a piezoelectric actuator acoustically coupled to each of the ink-carrying channels. A voltage differential is applied across the piezoelectric actuator acoustically coupled to the selected channel to cause a deformation of the piezoelectric actuator to impart the purging pressure pulse to the ink-carrying channel. In another aspect thereof, the voltage differential applied across the piezoelectric actuator coupled to the selected ink-carrying channel is at least twice the magnitude of the voltage differential applied across the piezoelectric actuator to cause the ejection of a droplet of ink from that inkcarrying channel. To enhance purging of the selected ink-carrying channel, the ink jet printhead may be ultrasonically vibrated during the application of the purging pressure pulse to the selected ink-carrying channel. The printhead should be ultrasonically vibrated at a frequency of at least 20 kHz or, more particularly, at a frequency between 40 kHz and 200 kHz.

In a further aspect thereof, each of the ink-carrying channels of the printhead are partially defined by first and second piezoelectric sidewall actuators. In this aspect, to apply a purging pressure pulse to the selected ink-carrying channel, a first, positive voltage and a first, negative voltage of equal magnitude are simultaneously applied to the first and second sidewall actuators. Next, a second, negative voltage and a second, positive voltage, also of equal magnitude, are simultaneously applied to the first and second sidewall actuators. In yet another aspect, the first, positive voltage, the first, negative voltage, the second, negative voltage and the second, positive voltage are at least two times the third, positive voltage, the third, negative voltage, the fourth, negative voltage and the fourth, positive voltage, respectively, which are applied to eject a droplet of ink from the ink-carrying channel. In still another aspect thereof, each sidewall actuator is shared between adjacent ink-carrying channels. In this aspect, the ink-carrying channels are divided into first, second and third groups such that every third ink-carrying channel is placed in the same group. The purging pressure pulse is then sequentially applied to all of the ink-carrying channels in the first group, the second group and the third group.

In another embodiment, the present invention is of an ink jet printhead having a main body portion and an internal ink-carrying channel extending through the main body portion and opening outwardly at the front side surface. The ink jet printhead further includes means for ejecting, from the ink-carrying channel, droplets of ink supplied to the ink-carrying channel by an associated ink supply. Ultrasonic vibrating means are mounted to an exterior surface of the main body portion such that the vibrations generated by the ultrasonic vibrating means forcibly ejects foreign matter from the ink-carrying channel. In one aspect, the ultrasonic vibrating means may be a piezoelectric crystal.

In another aspect thereof, the means for ejecting droplets of ink from the ink-carrying channel further includes a piezoelectric actuator acoustically coupled to the ink-carrying channel and means for applying a first voltage differential across the piezoelectric actuator. By applying the first voltage differential, the piezoelectric actuator undergoes a first deformation, thereby imparting a first pressure pulse to the inkcarrying channel coupled thereto to effect ejection of a droplet of ink therefrom. In a further aspect thereof, means for applying a second voltage differential greater than the first voltage differential across the piezoelectric actuator are also provided. By applying the second voltage differential, either alone or simultaneous with the ultrasonic vibration of the ink jet printhead, the piezoelectric actuator undergoes a second deformation, thereby imparting a second pressure pulse of sufficient force to forcibly eject foreign matter from the ink-carrying channel.

In yet another aspect thereof, the ink jet printhead further includes a controller electrically connected to the ultrasonic vibration means and the piezoelectric actuator to selectively or simultaneously vibrate the ink jet printhead and apply the first and second voltage differentials to the piezoelectric actuator. The ink jet printhead may also include heating means mounted to the exterior surface of the main body portion. In this aspect, the controller would be electrically connected to the heating means to selectively heat the ink jet printhead. In still another aspect thereof, the ink jet printhead further includes a top side surface to which the ultrasonic vibrating means and the heating means are mounted.

In yet another embodiment, the present invention is of an ink jet printhead which includes a body having parallel intersecured generally plate-like top, bottom and intermediate sections. A front end section having a spaced series of ink discharge orifices extending rearwardly therethrough is joined to the top, intermediate and bottom sections along aligned front edge surfaces thereof. A spaced, parallel series of internal deflectable sidewall sections extend rearwardly through the body from the front end section thereof and laterally bound a spaced series of internal ink-carrying channels interdigitated with the sidewall sections. The ink-carrying channels open outwardly through the discharge orifices and are in fluid communication with an ink supply to receive an ink flow therefrom. Ultrasonic vibrating means are mounted on a top side surface of the top section of the body such that ultrasonic vibrations generated by the ultrasonic vibrating means forcibly eject foreign matter from the ink-carrying channels and the discharge orifices.

In one aspect thereof, a controller is electrically connected with each of the deflectable sidewall sections such that a voltage differential may be selectively applied thereacross. By applying a first voltage differential to a first sidewall section laterally bounding one of the inkcarrying channels, a droplet of ink is ejected from the ink-carrying channel. Conversely, by applying a second voltage differential greater in magnitude than the first voltage differential to the first sidewall section, foreign material is forcibly ejected from the ink-carrying channel and the discharge orifice. In another aspect thereof, the ultrasonic vibrating means is also electrically connected to the controller so that the controller may selectively vibrate the ink jet printhead and apply the first and second voltage differentials to the selected sidewall section. In yet another aspect thereof, heating means are mounted on the top side surface of the top section. The heating means are electrically connected to the controller such that the controller may selectively vibrate or heat the ink jet printhead and apply the first and second voltage differentials to the selected sidewall section. In alternate further aspects thereof, the controller may apply voltage to the ultrasonic vibrating means at selected intervals for selected durations or upon deapplication of the first voltage differential to the sidewall sections.

In yet another embodiment, the present invention is of a method of purging foreign matter from an ink-carrying channel of an ink jet printhead configured to perform print operations by ejecting ink from the ink-carrying channel. In accordance with the method of the invention, the ink jet printhead is ultrasonically vibrated to forcibly eject foreign matter contained therein. In alternate aspects thereof, the ink jet printhead is ultrasonically vibrated at a frequency of at least 20 kHz or at a frequency between 40 kHz and 200 kHz. In further alternate aspects thereof, vibration may be initiated upon cessation of print operations or at selected time intervals for selected periods of time. In a further aspect thereof, the ink jet printhead may be shuttled from a print area where print operations are conducted to a maintenance area before initiating the ultrasonic vibration of the ink jet printhead. In a still further aspect thereof, the ink jet printhead may be heated while being ultrasonically vibrated.

DETAILED DESCRIPTION

Figure 1:
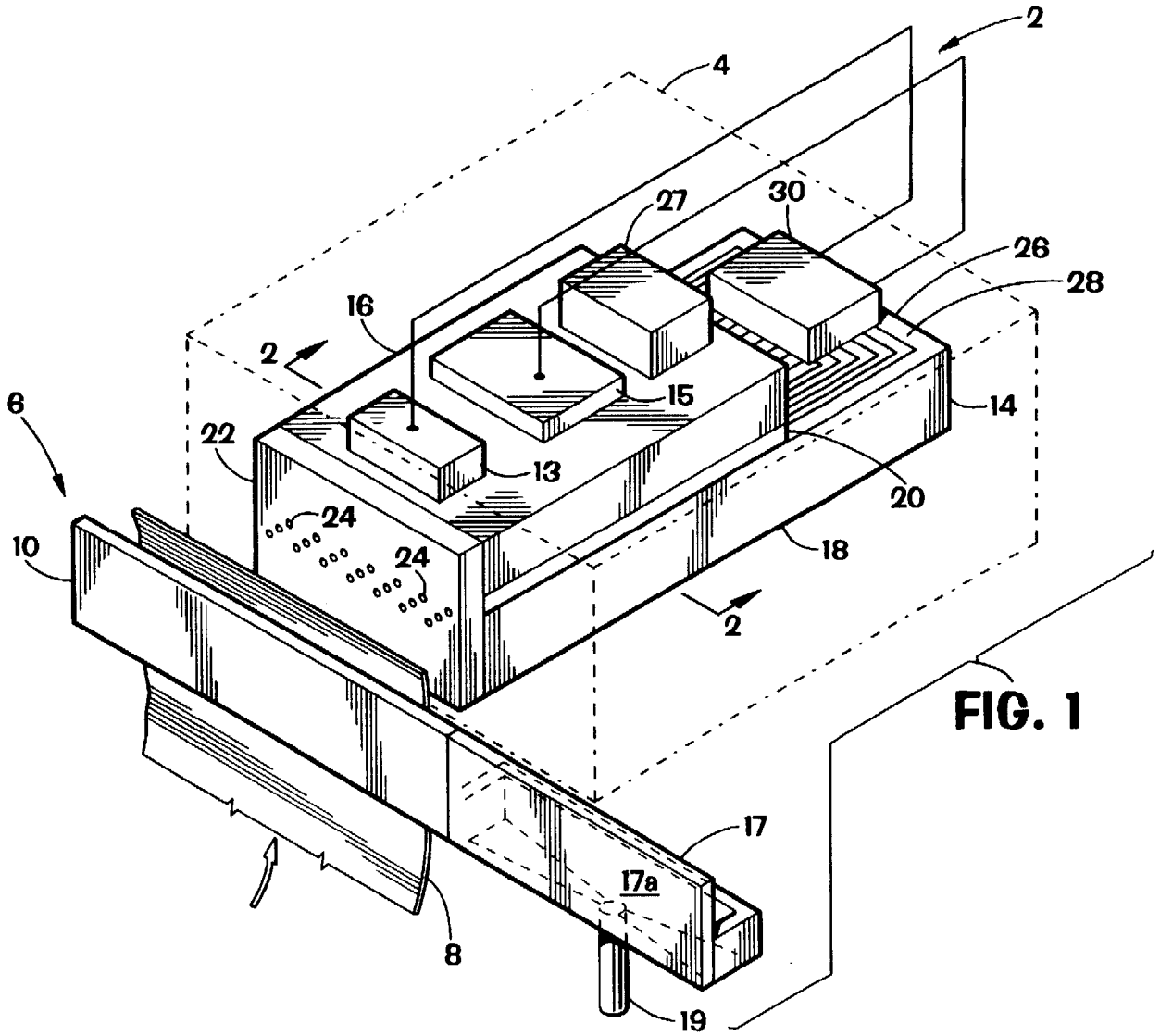
FIG. 1 is a perspective view of a specially designed, drop-on-demand ink jet printhead having an ultrasonic maintenance system constructed in accordance with the teachings of the present invention incorporated therewith.

Referring now to the drawing where like reference numerals designate the same or similar elements throughout the several views, in FIG. 1, a drop-on-demand ink jet printhead 2 may now be seen. The ink jet printhead 2 has a body 14 having upper and lower rectangular portions 16 and 18, with an intermediate rectangular body portion 20 secured between the upper and lower portions 16 and 18 in the indicated aligned relationship therewith. A front end section of the body 14 is defined by an orifice plate member 22 having a spaced series of small ink discharge orifices 24 extending rearwardly therethrough. As shown, the orifices 24 are arranged in horizontally sloped rows of three orifices each.

The printhead body portions 16,20 are shorter than the body portion 18, thereby leaving a top rear surface portion 26 of the lower printhead body portion 18 exposed. For purposes later described, a spaced series of electrical actuation leads 28 are suitably formed on the exposed surface 26 and extend between the underside of the intermediate body portion 20 and a controller 30 mounted on the exposed surface 26 near the rear end of the body portion 18.

Figure 2:
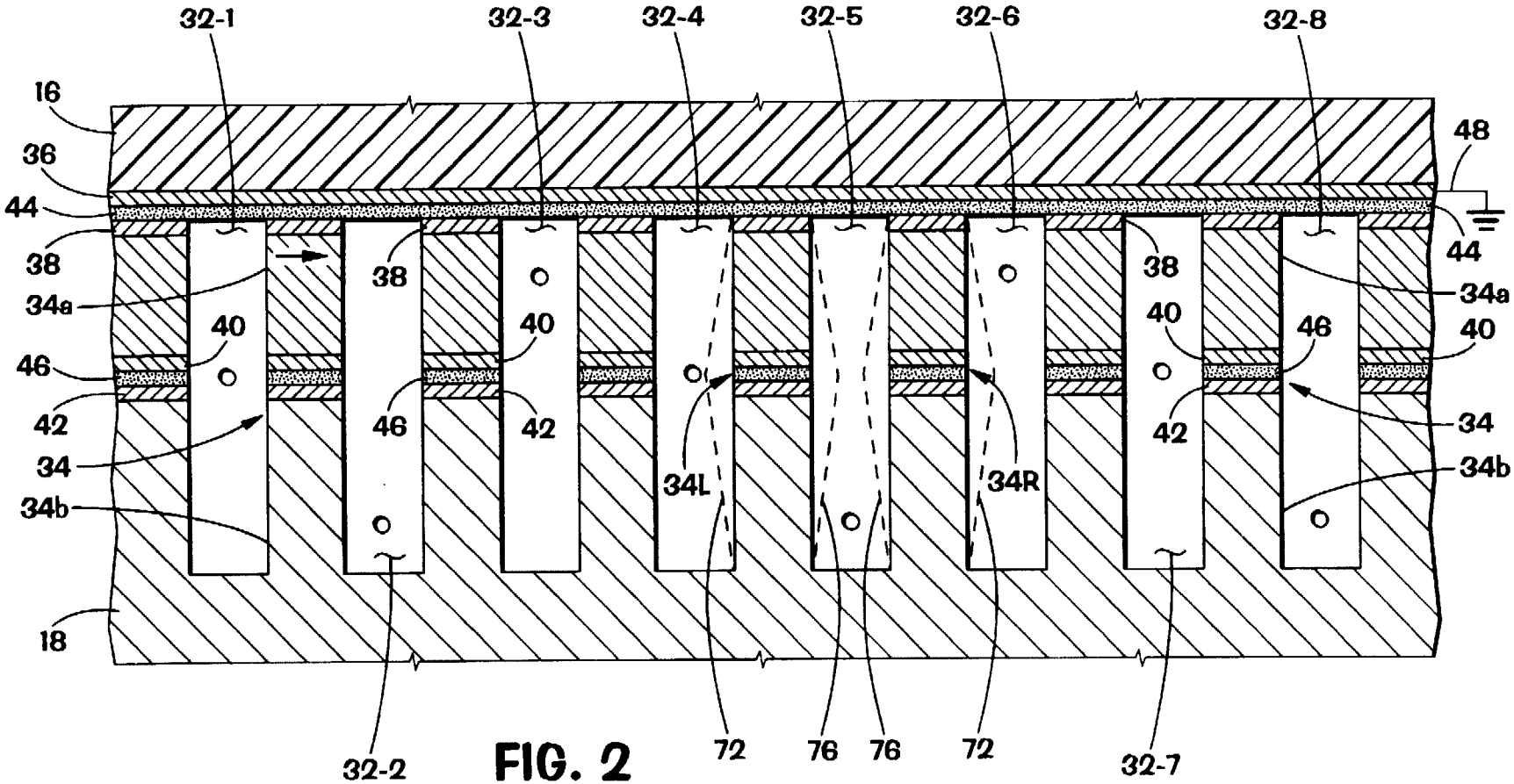
FIG. 2 is an enlarged scale, partial cross-sectional view through the ink jet printhead taken along line 2—2 of FIG. 1 and illustrating a plurality of piezoelectrically actuated ink-carrying channels suitable for ejecting droplets of ink therefrom.

Referring now to FIG. 2, a plurality of vertical grooves of predetermined width and depth are formed in the printhead body portions 18 and 20 to define within the printhead body 14 a spaced, parallel series of internal ink-carrying channels 32 that longitudinally extend rearwardly from the orifice plate 22 and open at their front ends outwardly through the orifices 24. The inkcarrying channels 32 are laterally bounded along their lengths by opposed pairs of a series of internal actuation sidewall sections 34 of the printhead body. Sidewall sections 34 have upper parts 34*a* defined by horizontally separated vertical sections of the body portion 20, and lower parts 34*b* defined by horizontally separated sections of the body portion 18. The underside of the body portion 16, the top and bottom sides of the actuation sidewall section parts 34*a*, and the top sides of the actuation sidewall section parts 34*b* are respectively coated with electrically conductive metal layers 36, 38, 40 and 42.

Body portions 16 and 20 are secured to one another by a layer of electrically conductive adhesive material 44 positioned between the metal layers 36 and 38, and the upper and lower actuator parts 34*a* and 34*b* are intersecured by layers of electrically conductive material 46 positioned between the metal layers 40 and 42. The metal layer 36 on the underside of. the upper printhead body portion 16 is connected to ground 48. Accordingly, the top sides of the upper actuator parts 34*a* are electrically coupled to one another and to ground 48 via the metal layers 38, the conductive adhesive layer 44 and the metal layer 36.

Each of the ink-carrying channels 32 is filled with ink received from a suitable ink supply reservoir 27 (see FIG. 1) connected to the ink-carrying channels 32 via an ink supply manifold (not shown) disposed within the printhead body 14 and coupled to rear end portions of the ink-carrying channels 32. In a manner subsequently described, each horizontally opposed pair of the sidewall actuators 34 is piezoelectrically deflectable into and out of their associated inkcarrying channel 32, under the control of the controller 30, to force ink (in droplet form) outwardly through the orifice 24 associated with the actuated ink-carrying channel 32.

Figure 3:
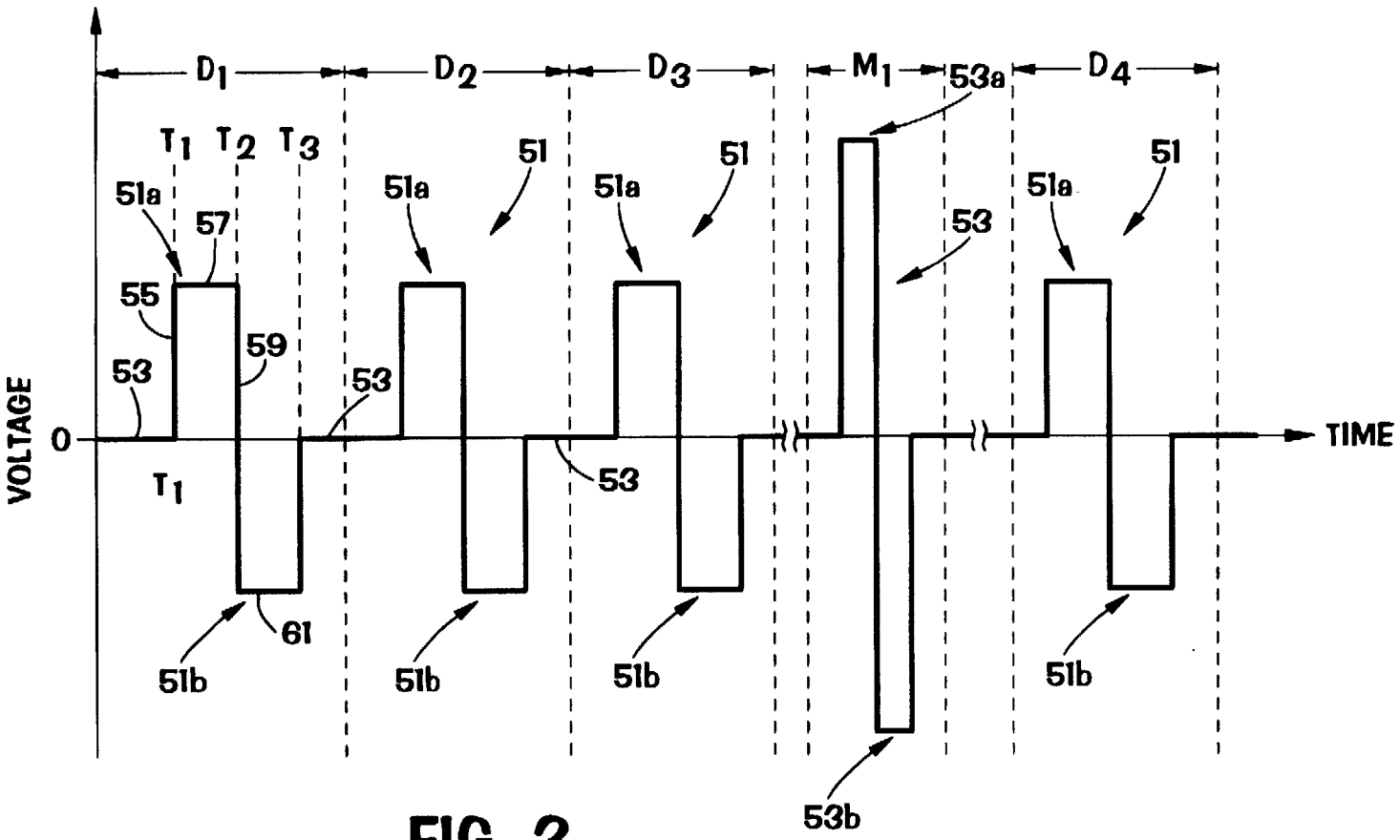
FIG. 3 is a schematic illustration of a voltage waveform suitable for application to the piezoelectrically actuated ink-carrying channels of FIG. 3 during both ink ejection and maintenance cycles.

Referring momentarily to FIG. 3, the voltage waveform to be applied to a horizontally opposed pair of sidewall actuators 34 to force the ejection of a droplet of ink out of their associated inkcarrying channel 32 will now be described in greater detail. The voltage waveform 51, also referred to as an "echo pulse" waveform, includes primary and echo portions 51*a*, 51*b* which generate a pressure wave in an ink-carrying channel of the ink jet printhead 2 to cause the ejection of a droplet of ink.

From a rest state 53, during which a rest state voltage is applied across a piezoelectric actuator 34 and the actuator remains in a undeflected rest position, the voltage waveform 51 begins a first rapid rise 55 at time $T_1$, to a first or peak voltage to be applied across the piezoelectric actuator 34. The first rapid rise 55 in the voltage waveform 53 causes the piezoelectric actuator 34 to move to a first, outwardly deflected position, thereby producing an expansive pressure wave that begins to propagate both forwardly and rearwardly through an ink-carrying channel 32 partially defined thereby.

Once reaching the peak value, the voltage waveform 51 enters a primary dwell state 57 which extends from time $T_1$ to time $T_2$. During the primary dwell state 57, the voltage is held constant at the first value to hold the piezoelectric actuator 34 in the deflected position. While the voltage waveform 51 is held in the dwell state 57, the rearwardly propagating negative pressure wave will have deflected off the back wall of the printhead 2 and propagated forwardly within the ink-carrying channel 32 to its origination point. When the forwardly propagating reflected pressure wave reaches its origination point at time $T_2$, the voltage waveform 51 begins a rapid fall 59 during which the voltage drops below the rest voltage (thereby ending the primary portion 51*a* and beginning the echo portion 51*b* of the voltage waveform 51) to a second, lower value. During the fall 59, the voltage applied across the piezoelectric actuator 34 drops to the second value, thereby causing the piezoelectric actuator 34 to move, from the first, outwardly deflected position, past the rest position, and into a second, inwardly deflected position which compresses the channel 32. By compressing the channel 32, the piezoelectric actuator 34 imparts a positive pressure wave into the channel which reinforces the forwardly propagating, reflected pressure wave.

Once reaching the second, lower value, the voltage waveform 51 enters an echo dwell state 61 which extends from time $T_2$ to time $T_3$. During this state, the voltage is held constant at the second value to hold the piezoelectric actuator 34 in the second, channel compressing, deflected position. While the voltage waveform 51 is held in the echo dwell state 61, the forwardly propagating reinforced pressure wave will propagate towards the orifice 24. At time $T_3$, the voltage waveform 51 will begin a second rapid rise 63 which will return the voltage waveform 51 to the rest state 53, thereby ending the echo portion 51*b* of the voltage waveform 51. The piezoelectric actuator 34 will move from the second, channel compressing, deflected position to the rest position, thereby imparting a negative pressure wave into the ink-carrying channel 32. This negative pressure wave acts as an active pull-up which prematurely terminates the droplet formation process by the forwardly propagating reinforced pressure pulse. Having returned to the rest state 53, the voltage waveform 51 remains at this state to allow the pressure pulse within the channel 34 to dissipate over time. In an exemplary embodiment of the invention, the rest, first and second voltages may be 0, +20 and −20 volts, respectively, and the dwell and echo dwell times may both be 10 μsec. It is specifically contemplated, however, that numerous other values other than those specifically disclosed herein may be used for the rest, first and second voltages. It is further contemplated that durations for the dwell and echo dwell times other than those specifically disclosed herein may also be used.

Using the controller 30, a selected one or more of the ink receiving channels 32 may be actuated to drive a quantity of ink therein, in droplet form, outwardly through the associated ink discharge orifice(s) 24. To illustrate this, the actuation of a representative ink-carrying channel 32-5 will now be described in conjunction with FIGS. 1–3. Prior to the actuation of the inkcarrying channel 32-5, its horizontally opposed left and right sidewall actuators $34_L$ and $34_R$ are (at time $T_0$ in FIG. 3) in initial, laterally undeflected (or "rest") positions indicated by solid lines in FIG. 2. To initiate the channel actuation cycle, the controller 30 is operated to impose upon the left sidewall actuator $34_L$ a constant positive DC voltage pulse (i.e. the primary portion 51*a*) during the time interval $T_1$–$T_2$ shown in FIG. 3. Simultaneously therewith, the controller 30 is further operated to impose upon the right sidewall actuator $34_R$ an equal constant negative DC voltage pulse during the time interval $T_1$–$T_2$. These opposite polarity DC voltage pulses transmitted to the sidewall actuators $34_L$ and $34_R$ outwardly deflect them away from the ink-carrying channel 32-5 being actuated and into the outwardly adjacent ink-carrying channels 32-4 and 32-6 as indicated by the dotted lines 72 in FIG. 2, thereby imparting respective compressive pressure pulses to the ink-carrying channels 32-4 and 32-6 and expansive pressure pulses to the ink-carrying channel 32-5.

Next, at time $T_2$, the positive voltage pulse transmitted to sidewall actuator $34_L$ and the corresponding negative voltage pulse on the sidewall actuator $34_R$ are terminated, and the controller 30 is operated to simultaneously impose a constant negative DC voltage pulse (i.e. the echo portion 51*b*) on the left sidewall actuator $34_L$, while imposing an equal constant positive DC voltage pulse on actuator $34_R$, during the time interval $T_2$ –$T_3$. These opposite polarity constant DC voltage pulses inwardly deflect the sidewall actuators $34_L$ and $34_R$past their initial undeflected positions and into the ink-carrying channel 32-5 as indicated by the dotted lines 76 in FIG. 2, thereby simultaneously imparting respective compressive pressure pulses into the ink-carrying channel 32-5. Such inward deflection of the sidewall actuators $34_L$ and $34_R$ reduces the volume of ink-carrying channel 32-5, thereby elevating the pressure of ink therein to an extent sufficient to force a quantity of the ink, in droplet form, outwardly through the orifice 24 associated with the actuated ink-carrying channel 32-5. This pulse or "drive" sequence is repeated each time a droplet is to be ejected from the actuated ink-carrying channel 32-5.

Continuing to refer to FIG. 3, a first embodiment of the present invention of a method and apparatus for maintaining an ink jet printhead 2 by forcibly ejecting foreign matter from the orifices 24 and their associate ink-carrying channels 32 thereof shall now be described in greater detail. As may now be seen, droplets of ink are periodically ejected from an ink-carrying channel 32 by the repeated applications of drive sequence "D". Between each successive drive sequences D1, D2 and D3, the ink-carrying channel 32 enters a rest state 53. While FIG. 3 illustrates the duration of the rest states 53 to be relatively short, it is specifically contemplated that the rest states 53 may be of any duration. As previously discussed, over a period of time, foreign matter will tend to accumulate in the orifice 24 and its associated ink-carrying channel 32 and its associated orifice 24. In accordance with the teachings of the present invention, the accumulated foreign matter may be forcibly ejected from the orifice 24 and its associated ink-carrying channel 32 by periodically applying a maintenance sequence "Ml" to selected ones or all of the ink-carrying, channels 32. After applying the maintenance sequence M1, the printhead may resume its primary purpose of generating droplets of ink by applying drive sequence D4.

As the maintenance sequence M1 is comprised of the generation of a purging pressure pulse intended to purge foreign matter that would not be ordinarily forced from the ink-carrying channel 32 during a normal drive sequence, the sidewall actuator 34 should apply greater force to the ink-carrying channel 32 associated therewith when applying the voltage waveform 53 which comprises the maintenance sequence M1 than when applying the voltage waveform 51 which comprises the drive sequences D1–D4. To generate the maintenance sequence Ml for a selected ink-carrying channel 32, the controller 30 applies a voltage waveform 53 similar in shape to the voltage waveform 51 but characterized by the application of higher positive and negative voltages to the sidewall actuators 34 bounding the ink-carrying channel 32 being purged. For example, if +20 volts and −20 volts are suitable levels for the main and echo portions of the drive sequence, voltage levels on the order of 2–4 times greater would be suitable for the main and echo portions 53*a*, 53*b* of the maintenance sequence M1. Furthermore, as the echo portion 53*b* of the maintenance sequence M1 is again timed to reinforce the reflection of the main portion 53*a* of the maintenance sequence M1, the duration of the main and echo portions 53*a*, 53*b* would be shortened, again on the order of 2–4 times relative to the main and echo portions 51*a*, 51*b* of the drive sequence D, to maintain this relationship.

Returning now to FIG. 1, the operation of the ink jet printhead 2 which utilizes the application of the maintenance sequence M1 to purge foreign matter from selected ink-carrying channels 32 and associated orifices 24 will now be described in greater detail. In operation, the printhead 2 would be periodically shuttled by drive means (not shown) from a printing area 10 where droplets of ink are ejected from orifices 24 associated with selected ink-carrying channels 32 by the application of the drive sequence D to the sidewall actuators 34 laterally bounding the selected inkcarrying channels 34 to a maintenance area 17 where foreign matter may be purged from selected orifices 24 and associated ink-carrying channels 32 of the ink jet printhead 2 by application of the maintenance sequence M1 to the sidewall actuators 34 laterally bounding the selected ink-carrying channels 34. For example, the ink jet printhead 2 may be shuttled after completing each page of print. Alternately, the ink jet printhead 2 may include means for counting the number of times each ink-carrying channel 34 is fired and comparing this number to a preselected threshold value. In this alternate configuration, the ink jet printhead 2 would be shuttled to the maintenance area 17 upon a determination that at least one of the ink-carrying channels 32 has been fired more times than the preselected threshold value. It should be noted that the positioning of the maintenance area 17 relative to the print area 10 is purely exemplary and that the maintenance area 17 may be positioned on the other side of the print area 10 without departing from the scope of the present invention.

Once positioned in the maintenance area 17, the controller 30 selectively applies maintenance sequence M1 to one or more of the ink-carrying channels 32. By deflecting the sidewalls 34 bounding a selected ink-carrying channel 32 to be purged, a purging pressure pulse is applied to the ink contained in the ink-carrying channel 32 which forces a quantity of ink through the associated orifice 24. Furthermore, as the voltage applied to the sidewalls 34 is greater than that normally applied during printing operations, the velocity of the ink contained in the selected ink-carrying channel 32 is greater during the maintenance process, thereby permitting the ink to dislodge foreign material from the selected ink-carrying channels 34 and their associated orifices 24 and to eject the dislodged material from the orifices 24 associated with the selected ink-carrying channels 34. However, as the ejected ink is at a higher velocity than normal, both the droplet size and trajectory will vary from that normally expected. Accordingly, it is highly recommended that this process take place in the maintenance area 17 which preferably includes a barrier wall 17a where the ejected ink will strike and a drainage port 19 for draining the ejected ink from the maintenance area 17. Alternately, a blotter (not shown) for absorbing ink ejected from the selected ink-carrying channels of the ink jet printhead 2 may be mounted on the barrier wall 17*a*.

Preferably, the controller 30 will selectively apply the maintenance pulse Ml to the various sidewalls 34 such that each and every orifice 24 and associated ink-carrying channel 32 is purged of foreign matter. For example, the controller 30 may simultaneously apply the maintenance sequence Ml to the sidewalls 34 defining every third ink-carrying channel at a time. In this example, a first group of orifices 24 and associated ink-carrying channels (ink-carrying channels 32-1, 32-4 and 32-7 would be purged first by applying a first maintenance sequence M1 to the sidewalls 34 defining those channels. A second group of orifices 24 and associated ink-carrying channels (ink-carrying channels 32-2, 32-5 and 32-8) would be purged next by applying a second maintenance sequence M2 to the sidewalls 34 defining those channels. Maintenance of the ink jet printhead 2 would then be completed by purging a third group of orifices 24 and associated ink-carrying channels (ink-carrying channels 32-3 and 32-6) by applying a third maintenance sequence M3 to the sidewalls 34 defining those channels. After the purging process is complete, the ink jet printhead 2 then returns to the printing area 10 and resumes printing.

Continuing to refer to FIG. 1, the ink jet printhead 2 is supportably mounted by a support structure (not shown) within a printhead housing 4. In turn, the printhead housing 4 is shuttled within an ink jet printer 6 by drive means (also not shown). As will be more fully described below, the drive means is configured to shuttle the printhead housing 4 across both the print area 10, where drops of ink are ejected from the selected channels 32 of the printhead 2 to form representations of images on a substrate, and the maintenance area 17, where the ink jet printhead 2 is cleaned of foreign matter and other debris.

During a printing process, a substrate, for example, a sheet 8 of paper stock, is operatively fed through the print area 10 of the ink jet printer 6. As the sheet 8 passes through the print area 10, a microcontroller (not shown) controls the overall operation of the ink jet printer 6 and, more specifically, the forming of an image on the sheet 8. As previously discussed, the ink jet printer 6 includes a plurality of ink-carrying channels 32 which are selectively activated to cause the ejection of droplets of ink therefrom. The ejected droplets strike the sheet 8 at specified locations to form the desired image.

For example, if the microcontroller was instructed by a computer system (also not shown) associated therewith to form a selected image at a specified location on the sheet 8, the microcontroller would instruct a drum motor to rotate a paper drum to advance sheet 8 within the ink jet printer 6 such that the appropriate line at which the image is to be formed is positioned such that an ink droplet or droplets selectively ejected by the ink jet printhead 2 would strike the sheet 8 along the line. The microcontroller would also instruct a printhead carriage motor to shuttle the printhead housing 4 such that the ink jet printhead 2 carried thereby is positioned along the selected line such that a droplet or droplets of ink ejected by the ink jet printhead 2 would strike the sheet 8 at the specified location or locations. Finally, the microcontroller would provide clock and print control signals to the controller 30 which, together with positional information regarding the sheet 8 provided by a rotary encoder, would indicate which ink-carrying channels 32 of the ink jet printhead 2 should be fired to form the desired image on the sheet 8. The controller 30 would then apply the drive sequence D to each of the sidewalls 34 bounded the selected ink-carrying channel or channels 34 of the ink jet printhead 2 to cause the ejection of a droplet or droplets of ink therefrom to form the desired image at the selected location.

Continuing to refer to FIG. 1, mounted to a top side surface of the upper body portion 16 are an ultrasonic vibrator 13 and a heater 15, both of which are electrically connected to the controller 30. The ultrasonic vibrator 13 is capable of generating vibratory motion at a frequency of at least 20 kHz and, preferably between 40 kHz and 200 kHz. As will be more fully described below, the ultrasonic vibrator 13 which, for example, may be either a piezoelectric crystal or a magnetostrictive transducer, may be used, either alone or in conjunction with a rapid displacement of the sidewall actuators 34 to force the removal of foreign particulate matter and other debris from the orifices 24 and the associated ink-carrying channels 32. The heater 15, which, for example, may be comprised of an electrical resistance heating wire positioned within a passageway formed in a housing, heats the ink contained in the ink-carrying channels 32 to lower the viscosity of the ink as well as to reduce the tendency of ink to agglomerate within the ink-carrying channels 32. Heating of the ink-carrying channels 32 may be used in combination with ultrasonic vibration of the ink jet printhead 2, the application of the maintenance pulse M1 to the ink-carrying channels 32, or both.

Ultrasonic vibration of the ink jet printhead 2 is considered to be a particularly useful technique to prevent accumulation of foreign matter or force accumulated foreign matter from the orifices 24 and associated ink-carrying channels 32. Furthermore, the use of this technique does not require the ink jet printhead 2 to first be shuttled to the maintenance area 17. Rather, ultrasonic vibration may be used while the ink jet printhead 2 is in the print area 10. By eliminating the need to shuttle the ink jet printhead 2 to the maintenance area 17, utilization of this technique will increase the operational speed of the ink jet printhead. Furthermore, it is relatively simple and inexpensive compared to other maintenance techniques, may be performed without the assistance of the computer operator and is suitable for maintaining page wide ink jet printheads.

More specifically, at selected times, the controller 30 applies a voltage differential across the ultrasonic vibrator 13 for a selected time period. Application of this voltage differential causes the ultrasonic vibrator 13 to vibrate at a frequency which is controllable by the magnitude of the voltage differential selected for application across the ultrasonic vibrator 13. As previously stated, the selected frequency should be at least 20 kHz and preferably between 40 kHz and 200 kHz. By vibrating the ink jet printhead 2 in this manner, foreign matter contained in the ink-carrying channels 32 and/or the orifices 24 is dislodged and forcibly ejected from the ink jet printhead 2 via the orifices 24. In alternate embodiments thereof, the ultrasonic vibration may be applied at different times for different durations. For example, a relatively brief ultrasonic vibration may be applied to the ink jet printhead each and every time a print operation is completed. Here, it is contemplated that a duration of 10 msec. should be sufficient to dislodge and forcibly eject foreign matter from the ink-carrying channels 32 and/or the orifices 24. Alternately, ultrasonic vibration may be applied at selected time intervals for selected durations, for example, a 10 msec. vibratory pulse may be applied once every second without interfering with an ongoing print operation, or ultrasonic vibration may be applied for a slightly longer duration, for example, a 0.1 sec. vibratory pulse may be applied at the start of each line of print. In yet another alternate embodiment, an ultrasonic vibratory pulse having a 10 msec duration may be applied after a preselected number of firings, for example, 100, of the ink-carrying channels 32.

It is further contemplated that the application of an ultrasonic vibratory pulse may be combined with the maintenance pulse M1 previously described at length. Here, at selected times, either while at rest or during a printing process, the printhead 2 and its associated housing 4 are shuttled across the print area 10 and to the maintenance area 17. Once positioned within the maintenance area 17, the purging of foreign matter from the ink-carrying channels 32 and the orifices 34 using the combined techniques may be initiated. To do so, the maintenance pulse Ml is applied to the selected ink-carrying channels 32 in the manner previously described. Simultaneously therewith, the ultrasonic vibratory pulse is applied to the ink jet printhead 2. Finally, to further enhance this maintenance technique, the heater 15 may also be activated to heat the ink contained in the ink-carrying channels 32 of the ink jet printhead 2.

Thus, there has been described and illustrated herein, an ink jet printhead having an ultrasonic maintenance system incorporated therein and an associated method of maintaining an ink jet printhead by purging foreign matter therefrom. It should be clearly understood, however, that the foregoing detailed description is given by way of illustration and example only, the spirit and scope of the present invention being limited solely by the appended claims.

What is claimed is:

1. For an inkjet printer having a print area where droplets of ink are ejected onto a substrate to form a representation of an image, a maintenance area and a shuttle ink jet printhead movable between said print area and said maintenance area, said ink jet printhead having a main body portion having a front side surface, at least one ink-carrying channel interiorly extending from said front side surface and means for selectively applying a pressure pulse to each of said at least one ink-carrying channel to cause the ejection of a droplet of ink therefrom, a method of purging foreign matter from selected ones of said at least one ink-carrying channel, comprising the steps of:

selecting one of said ink-carrying channels for purging;

ceasing all printing operations;

shuttling said ink jet printhead from said print area to said maintenance area;

applying a pressure pulse to said selected channel to purge foreign matter therefrom, wherein the step of applying a pressure pulse to said selected channel to purge foreign matter therefrom further comprises the step of applying a voltage differential across said piezoelectric actuator acoustically coupled to said selected channel to cause a deformation of said piezoelectric actuator which imparts said purging pressure pulse to said selected ink-carrying channel, wherein the step of applying a pressure pulse to said selected channel to purge foreign matter therefrom further comprises the steps of:

applying a voltage differential across said piezoelectric actuator coupled to said selected ink-carrying channel having a magnitude at least twice as great as the voltage differential applied across said piezoelectric actuator to cause the ejection of a droplet of ink from said selected channel;

ultrasonically vibrating said ink jet printhead during application of said purging pressure pulse to said selected ink-carrying channel; and wherein said pressure-applying step requires no other pressure-applying action; shuttling said ink jet printhead from said maintenance area to said print area; and resuming said printing operations.

2. A method of purging foreign matter from selected ones of said ink-carrying channels according to claim 1 wherein said ink jet printhead is ultrasonically vibrated at a frequency of at least 20 kHz.

3. A method of purging foreign matter from selected ones of said ink-carrying channels according to claim 1 wherein said ink jet printhead is ultrasonically vibrated at a frequency between 40 kHz and 200 kHz.

4. A method of purging foreign matter from selected ones of said ink-carrying channel according to claim 1 wherein each of said ink-carrying channels are partially defined by first and second piezoelectric sidewall actuators and wherein the step of applying a pressure pulse to said selected ink-carrying channel to purge foreign matter therefrom further comprises the steps of:

applying a first, positive voltage to said first sidewall actuator and a first, negative voltage of equal magnitude to said second sidewall actuator for a first selected period of time; and applying a second, negative voltage to said first sidewall actuator and a second, positive voltage of equal magnitude to said second sidewall actuator for a second selected period of time.

5. A method of purging foreign matter from selected ones of said at least one ink-carrying channel according to claim 4 wherein a droplet of ink is ejected from said ink-carrying channel by applying a third, positive voltage to said first sidewall actuator and a third, negative voltage to said second sidewall for a third selected period of time and applying a fourth, negative voltage to said first sidewall actuator and a fourth, positive voltage to said second sidewall for a fourth selected period of time and wherein said first, positive voltage, said first, negative voltage, said second, negative voltage and said second, positive voltage are at least two times said third, positive voltage, said third, negative voltage, said fourth, negative voltage and said fourth, positive voltage, respectively.

6. A method of purging foreign matter from selected ones of said at least one ink-carrying channel according to claim 5 wherein each said sidewall actuator is shared between adjacent ink-carrying channels and wherein the step of applying a pressure pulse to said selected ink-carrying channel to purge foreign matter therefrom further comprises the steps of:

dividing said ink-carrying channels into first, second and third groups such that every third ink-carrying channel is placed in the same group;

sequentially applying said pressure pulse to all of said ink-carrying channels in said first group, said second group and said third group.

7. A method of purging foreign matter from selected ones of said ink-carrying channels according to claim 6 and further comprising the step of ultrasonically vibrating said ink jet printhead during said application of said purging pressure pulse to said selected ink-carrying channel.

8. A method of purging foreign matter from selected ones of said ink-carrying channels according to claim 7 wherein said ink jet printhead is ultrasonically vibrated at a frequency of at least 20 kHz.

9. A method of purging foreign matter from selected ones of said ink-carrying channels according to claim 7 wherein said ink jet printhead is ultrasonically vibrated at a frequency between 40 kHz and 200 kHz.

10. An inkjet printhead, comprising:

a main body portion having a front side surface and an internal ink-carrying channel extending through said main body portion and opening outwardly at said front side surface, said ink-carrying channel being in fluid communication with an ink supply to receive an ink flow therefrom;

means for ejecting droplets of ink from said ink-carrying channel;

ultrasonic vibrating means mounted to an exterior surface of said main body portion;

a piezoelectric actuator acoustically coupled to said ink-carrying channel; and means for applying a first voltage differential across said piezoelectric actuator acoustically coupled to said ink-carrying channel, said first voltage differential causing a first deformation of said piezoelectric actuator which imparts a first pressure pulse to said ink-carrying channel to effect ejection of a droplet of ink therefrom:

wherein ultrasonic vibration generated from said ultrasonic vibrating means forcibly ejects foreign matter from said ink-carrying channel; and wherein said ultrasonic vibrating means further comprises a piezoelectric crystal.

11. An ink jet printhead according to claim 10 and further comprising means for applying a second voltage differential greater than said first voltage differential across said piezoelectric actuator acoustically coupled to said ink-carrying channel, said second voltage differential causing a second deformation of said piezoelectric actuator which imparts a second pressure pulse to said ink-carrying channel to forcibly eject foreign matter from said ink-carrying channel.

12. An ink jet printhead according to claim 10 and further comprising a controller and electrically connected to said ultrasonic vibration means and said piezoelectric actuator, said controller selectively vibrating said inkjet printhead and applying said first and second voltage differentials to said piezoelectric actuator.

13. An ink jet printhead according to claim 10 and further comprising heating means mounted to said exterior surface of said main body portion.

14. An ink jet printhead according to claim 13 and further comprising a controller electrically connected to said ultrasonic vibration means, said heating means and said piezoelectric actuator, said controller selectively vibrating said ink jet printhead, heating said ink jet printhead and applying said first and second voltage differentials to said piezoelectric actuator.

15. An ink jet printhead according to claim 14 wherein said main body portion further comprises a top side surface on which said ultrasonic vibrating means and said heating means are mounted.

16. An ink jet printhead, comprising:

a body having parallel intersecured generally plate-like top, bottom and intermediate sections with each section having a top side surface, a bottom side surface and aligned front edge surfaces;

a front end section joined to said top, intermediate and bottom sections along said aligned front edge surfaces thereof, said front end section having a spaced series of ink discharge orifices extending rearwardly therethrough;

a spaced, parallel series of internal deflectable sidewall sections extending rearwardly through said body from said front end section thereof and laterally bounding a spaced series of internal ink-carrying channels interdigitated with said sidewall sections and opening outwardly through said discharge orifices, said ink-carrying channels being in fluid communication with an ink supply to receive an ink flow therefrom;

ultrasonic vibrating means mounted on said top side surface of said top section of said body;

wherein ultrasonic vibration generated by said ultrasonic vibrating means forcibly ejects foreign matter from said ink-carrying channels and said discharge orifices;

a controller; and connection means for electrically connecting said controller with each of said deflectable sidewall sections to apply a selected voltage differential thereacross;

wherein application of a first voltage differential to a first sidewall section laterally bounding one of said inkcarrying channels causes ejection of a droplet of ink from said ink-carrying channel and wherein application of a second voltage differential greater in magnitude than said first voltage differential to said first sidewall section causes forcible ejectment of foreign material from said ink-carrying channel and said discharge orifice.

17. An ink jet printhead according to claim 16 wherein said ultrasonic vibrating means is electrically connected to said controller, said controller configured to selectively vibrate said ink jet printhead and apply said first and second voltage differentials to said selected sidewall section.

18. An ink jet printhead according to claim 17 and further comprising heating means mounted on said top side surface of said top section, said heating means electrically connected to said controller, said controller configured to selectively vibrate said ink jet printhead, heat said ink jet printhead and apply said first and second voltage differentials to said selected sidewall section.

19. An ink jet printhead according to claim 17 wherein said controller further comprises means for applying a voltage to said ultrasonic vibrating means at selected intervals for selected durations, said applied voltage causing said ultrasonic vibrating means to vibrate said ink jet printhead.

20. An ink jet printhead according to claim 19 wherein said controller further comprises means for applying a voltage to said ultrasonic vibrating upon deapplication of said first voltage differential to said sidewall sections, said ultrasonic vibrating means vibrating said printhead during non-ink droplet ejecting rest periods.

* * * * *